US007475937B2

(12) United States Patent
McGrew et al.

(10) Patent No.: US 7,475,937 B2
(45) Date of Patent: Jan. 13, 2009

(54) EATING SURFACE WITH INTERCHANGEABLE ACCESSORIES

(76) Inventors: Alan R. McGrew, 26140 W. 111 Place, Olathe, KS (US) 66061; Adela R. McGrew, 26140 W. 111 Place, Olathe, KS (US) 66061

( * ) Notice: Subject to any disclaimer, the term of this patent is extended or adjusted under 35 U.S.C. 154(b) by 89 days.

(21) Appl. No.: 11/532,184

(22) Filed: Sep. 15, 2006

(65) Prior Publication Data

US 2008/0067840 A1 Mar. 20, 2008

(51) Int. Cl.
*A47B 83/02* (2006.01)

(52) U.S. Cl. ..... 297/148; 297/153; 108/26

(58) Field of Classification Search ..... 297/153, 297/148; 108/26

See application file for complete search history.

(56) References Cited

U.S. PATENT DOCUMENTS 3,148,636 A * 9/1964 Blomquist et al. ..... 108/26
4,908,066 A 3/1990 Taylor et al.
4,927,024 A 5/1990 Lloyd
5,368,183 A 11/1994 Singer
5,558,391 A * 9/1996 Chavous ..... 297/153 X
5,586,800 A 12/1996 Triplett
5,720,226 A 2/1998 Padavano
5,871,098 A 2/1999 Storck
5,975,628 A 11/1999 Russell
6,179,377 B1 1/2001 Harper
6,216,605 B1 4/2001 Chapman

FOREIGN PATENT DOCUMENTS

GB 2121270 12/1983

* cited by examiner

*Primary Examiner*—Anthony D Barfield
(74) *Attorney, Agent, or Firm*—Hovey Williams LLP

(57) ABSTRACT

An eating surface assembly comprising a tray for supporting food items thereon; a socket integrally formed in the tray; a receptacle; and a plug integrally formed on the receptacle. The plug is adapted for mating with the socket in the tray for releasably securing the receptacle on top of the tray. The plug includes a flange which is sized and configured so that its upper surface is substantially flush with the upper surface of the tray when the receptacle is secured to the tray. This creates a substantially continuous, uniform, level surface around the receptacle.

19 Claims, 5 Drawing Sheets

EATING SURFACE WITH INTERCHANGEABLE ACCESSORIES

BACKGROUND OF THE INVENTION

1. Field of the Invention

The present invention relates to highchair trays and other eating surfaces. More particularly, the invention relates to an eating surface with structure for releasably securing food and drink receptacles and other interchangeable accessories thereon.

2. Description of the Prior Art

Infants, small children, and people with disabilities or other health problems are prone to spilling food and drinks from bowls, cups, and other receptacles and knocking the receptacles from highchairs, hospital trays, tables, and other eating surfaces. Various devices and systems, such as those disclosed in U.S. Pat. Nos. 6,216,605; 4,908,066; 4,927,024; 5,871,098; 5,368,183; 5,720,226; 5,586,800; 6,179,377; and 5,975,628; and UK Patent Application Ser. No. 2121270, have been developed to releasably secure receptacles to high chair trays and other eating surfaces. While these prior art devices and systems alleviate many of the aforementioned problems, they are too complex and costly, don't securely support food and drink receptacles to eating surfaces, aren't easy to attach and remove, and/or are difficult to keep clean and sanitary.

Accordingly, there is a need for an improved eating surface with structure for releasably securing receptacles thereon that overcomes the limitations of the prior art.

SUMMARY OF THE INVENTION

The present invention solves the above-described problems and provides a distinct advance in the art of trays and other eating surfaces designed for releasably securing food and drink receptacles. More particularly, the present invention provides an eating surface assembly that is relatively simple and inexpensive to construct, securely supports food and drink receptacles, is easy to attach and remove, and is easy to keep clean and sanitary.

One embodiment of the invention is an eating surface assembly comprising a tray for supporting food items thereon; a socket integrally formed in the tray; a receptacle such as a bowl, plate, or cup; and a plug integrally formed on the receptacle. The plug is adapted for mating with the socket in the tray for releasably securing the receptacle on top of the tray. The plug includes a flange which is sized and configured so that its upper surface is substantially flush with the upper surface of the tray when the receptacle is secured to the tray. This creates a substantially uniform, level surface around the receptacle so that other items, such as utensils and other food and drink receptacles, can be evenly supported on top of the tray. This also prevents food, liquid, and debris from accumulating around the receptacle when it is secured to the tray.

Another embodiment of the invention is an eating surface assembly comprising a tray for supporting food items thereon; a socket integrally formed in the tray; a receptacle; and a plug integrally formed on the receptacle and adapted for mating with the socket in the tray for releasably securing the receptacle on top of the tray. The plug includes a circumscribing flange and at least one locking tab depending from the bottom of the flange. The flange and the locking tab each present an outer margin, with the outer margin of the locking tab being radially within the outer margin of the flange. This permits the flange to substantially cover the locking tab and the socket so that neither are visible when the receptacle is attached to the tray.

The socket and plug of these and other embodiments of the invention are preferably bayonet-type connectors which can be quickly and easily operated to attach or detach the receptacle to the tray. The various embodiments of the eating surface assembly may also include a gasket or other seal for positioning between the receptacle plug and the tray socket for substantially sealing any gaps therebetween.

The eating surface assembly is preferably embodied as a tray that may be removably attached to an otherwise conventional highchair having a seat and leg structure for supporting and elevating the seat above a floor or other surface. However, the eating surface assembly may also be embodied in a stand-alone tray such as those used with bed-ridden patients, a tabletop, a desktop, a bar, a TV tray, or any other eating surface. The eating surface assembly may also include a removable cover which can be coupled with the socket to cover the socket when the receptacle is removed from the tray.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

Figure 1:
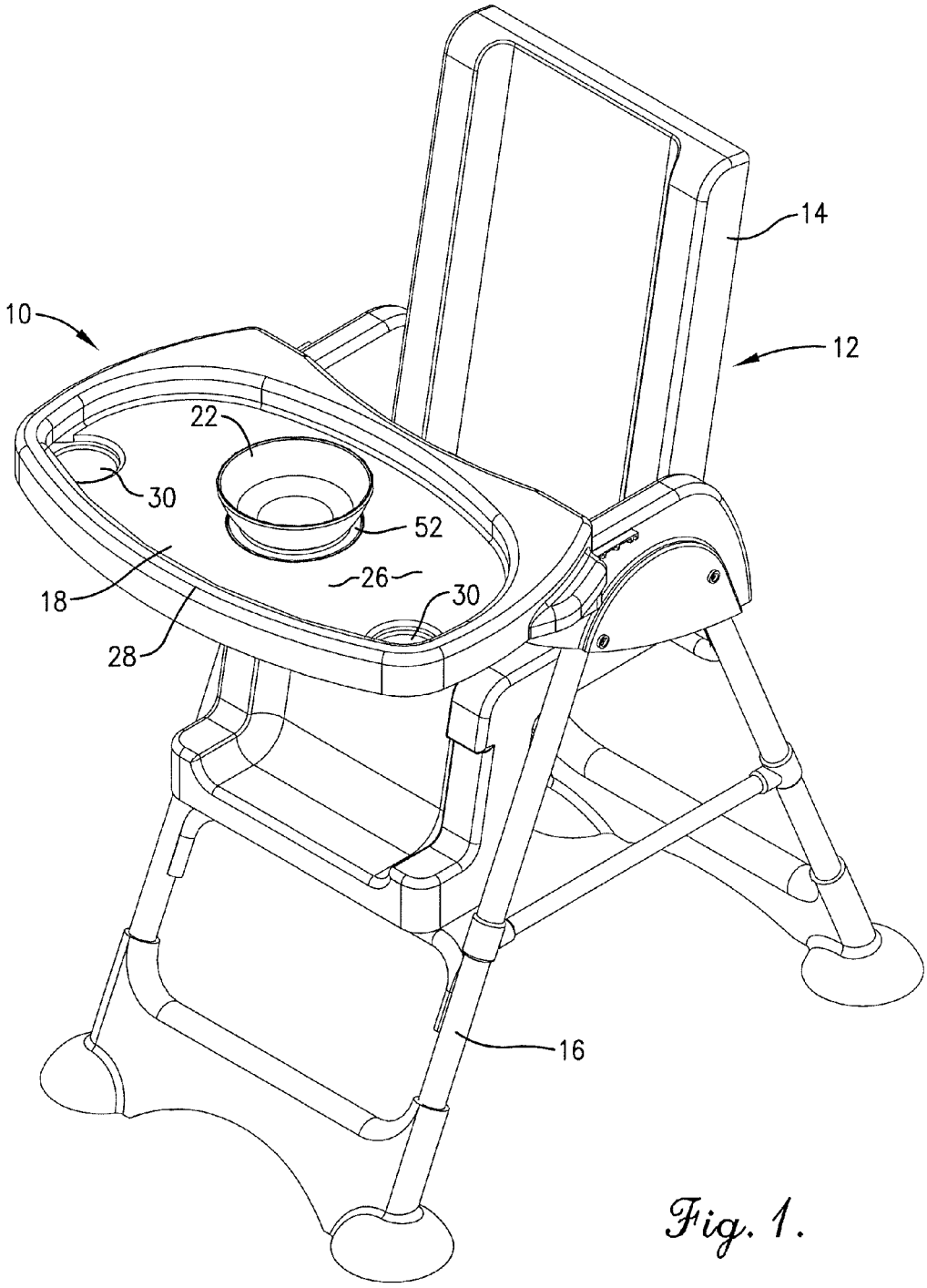
FIG. 1 is a perspective view of an eating surface assembly constructed in accordance with a preferred embodiment of the present invention and shown attached to an examplary high chair.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
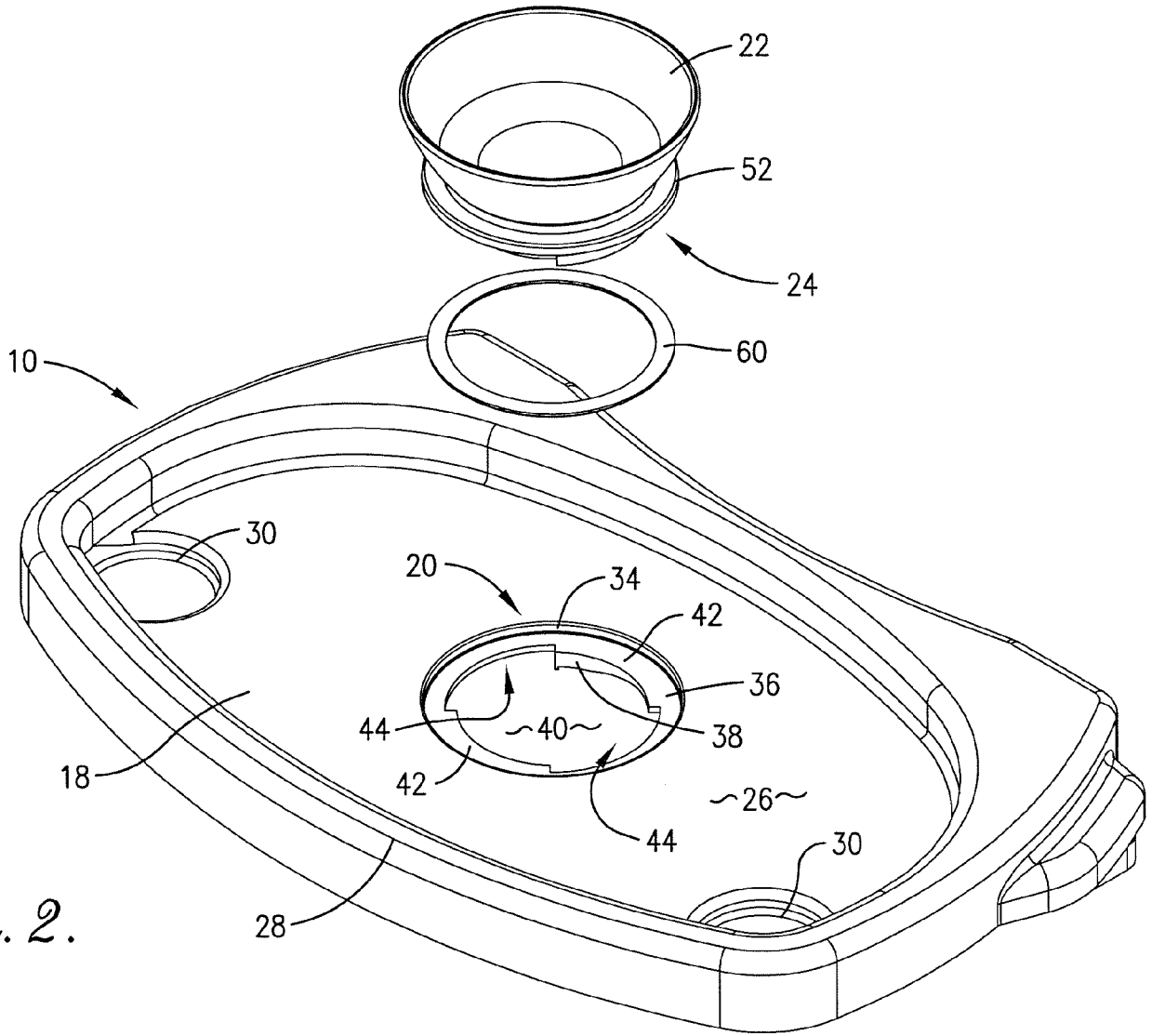
FIG. 2 is an exploded top perspective view of the eating surface assembly illustrating the receptacle removed from the tray.

Turning now to the drawing figures, and particularly FIGS. 1 and 2, an eating surface assembly 10 constructed in accordance with a preferred embodiment of the invention is illustrated. The eating surface assembly 10 is preferably embodied as a tray that may be removably attached to an otherwise conventional highchair 12 having a seat 14 and leg structure 16 for supporting and elevating the seat above a floor or other surface. However, the eating surface assembly 10 may also be embodied in a stand-alone tray such as those used with bedridden patients, a tabletop, a desktop, a bar, a TV tray, or any other eating surface. One embodiment of the eating surface assembly 10 broadly includes a tray 18 for supporting food items thereon; a socket 20 integrally formed in the tray; a receptacle 22 for holding food or liquids; and a plug 24 integrally formed on the receptacle. Each of these components is described in more detail below.

Figure 3:
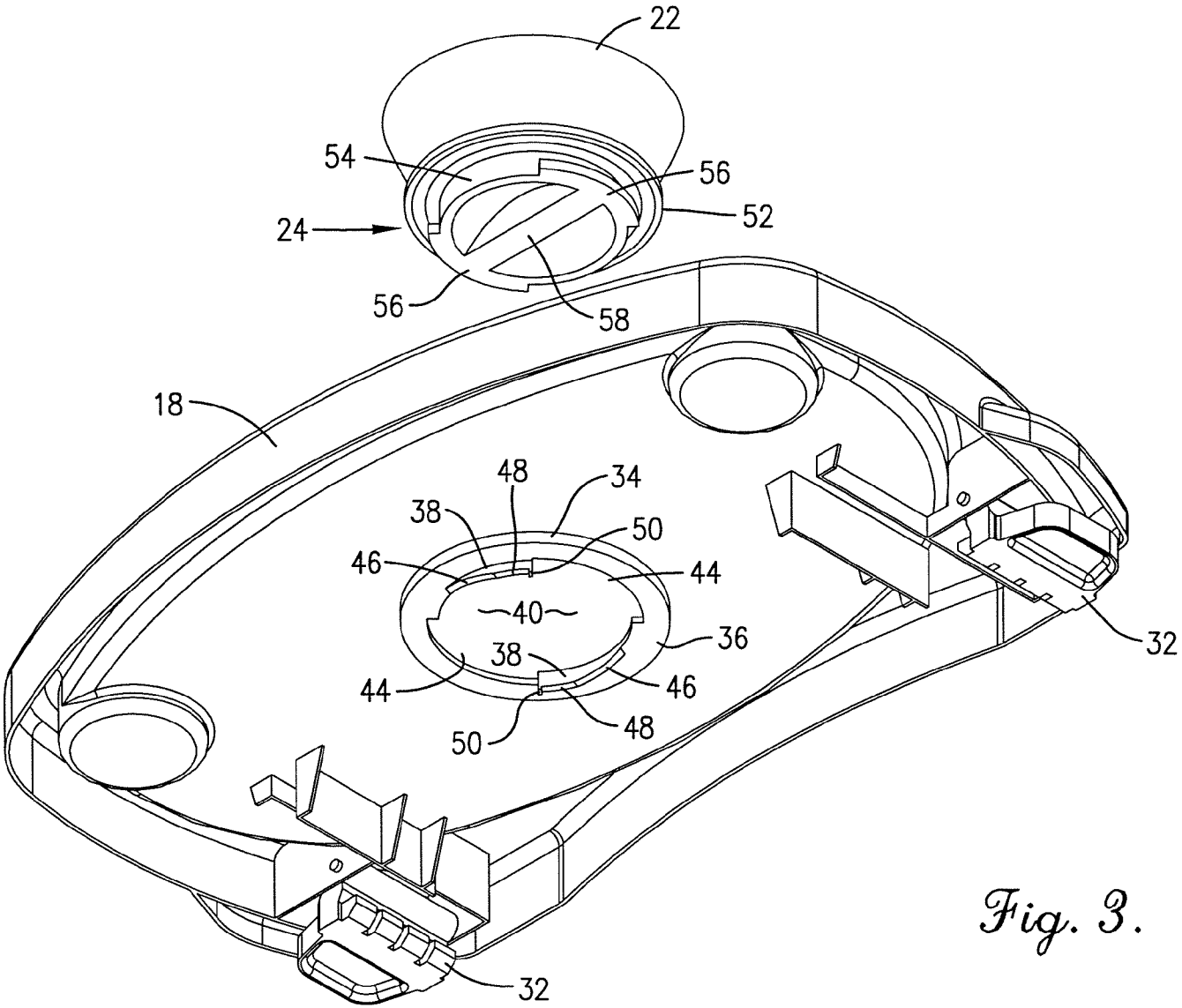
FIG. 3 is an exploded bottom perspective view of the eating surface assembly illustrating the receptacle removed from the tray.

The tray 18 is largely conventional and may be formed of any suitable material such as molded plastic or other synthetic resin materials or even metal or wood. The tray includes a generally planar eating surface 26 and a raised periphery 28 for containing food, drinks, and other items within the confines of the eating surface. The tray may also include a number of circular recessed regions 30 that serve as cupholders. As best illustrated in FIG. 3, one embodiment of the tray 18 also includes structure 32 for removably attaching the tray to the highchair 12 illustrated in FIG. 1. The tray may also be equipped with other attachment structure for supporting the tray to other objects such as a hospital bed, a table, a stand, etc.

The socket 20 is preferably integrally molded or otherwise formed into the tray 18 for releasably receiving the receptacle plug 24. The socket 20 and the plug 24 are preferably bayonet-type connectors that permit the receptacle 22 to be quickly and securely attached or detached from the tray with a minimum amount of manipulation as described in more detail below. The socket and plug may instead be releasably coupled by a threaded connection, with conventional threads on the plug and corresponding grooves on the socket (or vice versa). However, a threaded connection is not preferred because it requires more precise alignment of the plug 24 and socket 20 to initially seat the threads within the corresponding grooves, requires more revolutions of the receptacle 22 relative to the tray to fully thread the plug into the socket, and is prone to the accumulation of food and other debris in the threads and grooves, thus requiring more frequent and thorough cleaning of the plug and socket.

As best illustrated in FIGS. 2 and 3, the socket 20 includes a generally vertically-extending cylindrical sidewall 34 depending from the top surface 26 of the tray 18; a generally horizontally-extending shelf 36 projecting inwardly from a lower edge of the cylindrical sidewall, and a pair of spaced, inclined locking ramps 38 depending from a lower face of the shelf. The cylindrical sidewall 34 is preferably approximately ⅛-¼" deep to recess the upper surface of the shelf 36 the same distance below the upper surface 26 of the tray 18 and is preferably approximately 3-5" in diameter to receive a similarly dimensioned plug as discussed in more detail below. However, the particular dimensions of the sidewall, and the other components of the eating assembly, may be changed without departing from the scope of the invention. The sidewall 34 may also be angled inwardly approximately 30° so that it is conical in shape rather than being vertical.

The shelf 36 extends horizontally inwardly from the lower edge of the cylindrical sidewall 34 and defines a central aperture 40 extending through the tray 18. The shelf includes two arcuate areas 42 of increased width which define a pair of opposed keyway slots 44. The areas of increased width are preferably approximately ⅛-¼" wider than the remainder of the shelf so that the keyway slots each extend approximately ⅛-¼" beyond the rest of the aperture 40. In one embodiment, the diameter of the aperture between the enlarged areas 42 is between 2.5-4.5" and the diameter including the keyway slots 44 is ¼-½" greater. The circumferential length of each keyway slot 44 is preferably approximately ½-1½".

The locking ramps 38 depend from the lower surface of the shelf 36 as best illustrated in FIG. 3 and each include an inclined surface 46, a generally horizontal surface 48, and a raised end 50 which serves as a stop. The locking ramps 38 are generally centered on opposite sides of the aperture 40 between the two keyway slots 44.

Figure 7:
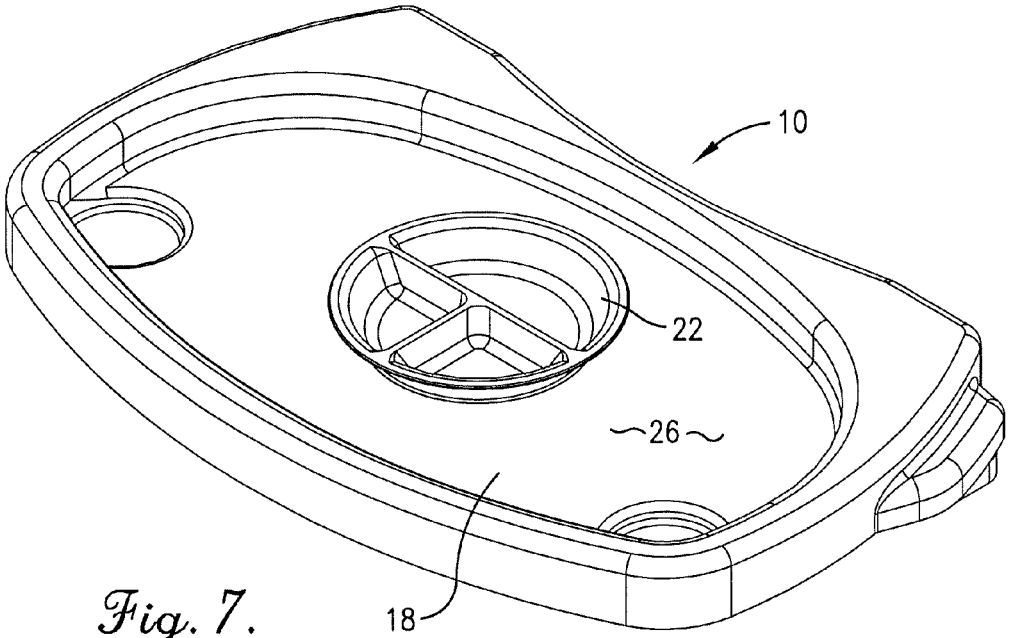
FIG. 7 is a perspective view of an eating surface assembly constructed in accordance with yet another preferred embodiment of the invention.

The receptacle 22 itself is mostly conventional and may be embodied as a bowl as illustrated in FIGS. 1-3 and 5, a compartmentalized plate as illustrated in FIG. 7, a non-compartmentalized plate, a saucer, a cup, or any other device capable of containing food or liquids. The receptacle 22 is preferably formed of plastic or other generally unbreakable, dishwasher-safe materials so that it can be safely used by an infant and easily cleaned.

The plug 24 is integrally formed at the base of the receptacle 22 and is adapted for mating with the socket 20 in the tray 18 for releasably securing the receptacle on top of the tray. The plug is preferably a bayonet-type plug as mentioned above and includes a circumscribing flange 52 extending radially outward from a lower surface of the receptacle; a hollow, generally ring-shaped base 54 depending from a lower surface of the flange; and a pair of locking tabs 56 extending radially outward from a lower surface of the base. The plug may also include a crossbar 58 bisecting the base which serves as a handle for facilitating tightening and loosening of the plug within the socket as discussed in more detail below. Other gripping means such as finger holes may be provided instead of the crossbar.

Figure 5:
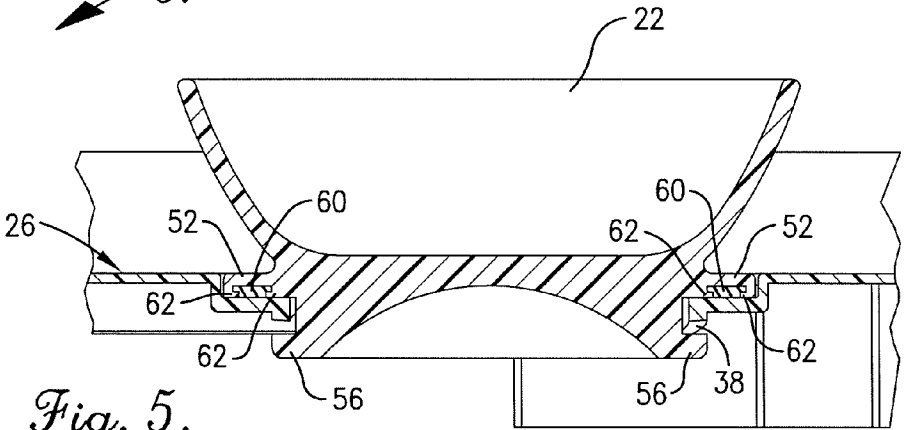
FIG. 5 is a partial vertical section view of certain components of the eating surface assembly.

The flange 52 is preferably washer-shaped and is dimensioned to snugly fit within the confines of the cylindrical sidewall 34 of the socket 20. The thickness of the flange is the same as the recessed depth of the socket shelf 42 so that the upper surface of the flange is substantially flush with the upper surface of the tray when the receptacle is secured to the tray as best illustrated in FIGS. 1 and 5. This creates a substantially uniform, level surface around the receptacle 22 so that other items, such as utensils and other food and drink receptacles, can be evenly supported on top of the tray. The level surface also prevents food, liquid and debris from accumulating around the base of the receptacle and makes it easier to clean the tray while the receptacle is attached thereto. If the sidewall 34 is vertical, the peripheral wall of the flange 52 is also vertical. However, if the sidewall 34 is angled inwardly as mentioned above, the peripheral wall of the flange 52 is also angled to snugly fit within the socket 20.

The ring-shaped base 54 is dimensioned and shaped to extend through the socket aperture 40 when the receptacle 22 is attached to the tray 18. In one embodiment, the base is approximately ¼-½" tall and slightly less than 2.5-4.5" in diameter. The locking tabs 56 are dimensioned and shaped to fit within and extend through the keyway slots 44 of the socket 20. In one embodiment, the locking tabs each extend approximately ⅛-¼" beyond the outer margin of the base 54 and are approximately ½-1½" in length. As described in more detail below, the plug 24 can only be fully seated within the socket 20 when the locking tabs are initially aligned with the keyway slots 44.

The lowermost surfaces of the base 54, the locking tabs 56 and the crossbar 58, are preferably level and in the same plane to form a level base for evenly supporting the receptacle 22 on a table, countertop, or other surface when the receptacle is not attached to the tray 18. Eliminating protruding surfaces from the lowermost surfaces of the base, locking tabs and crossbar also reduces irritation and injury to a user's legs when they contact the underside of the tray.

In preferred forms, the surfaces of the locking tabs 56 which extend furthest from the base 54 are radially within the outermost edge of the flange 52 as best illustrated in FIGS. 3 and 5. Thus, when viewed from the top, the flange completely covers the locking tabs. This reduces the amount of surface area on the tray that is taken up by the socket (larger locking tabs would require a correspondingly larger socket) and permits the flange and attached receptacle to substantially cover the socket.

The eating surface assembly 10 also preferably includes a ring-shaped gasket 60 or other seal for positioning between the receptacle plug 24 and the tray socket 20 for substantially sealing any gaps therebetween. As best illustrated in FIG. 5, the flange 52 may also include a pair of depending, generally L-shaped ledges 62 which define a T-shaped slot for receiving and retaining the gasket therein.

Figure 4:
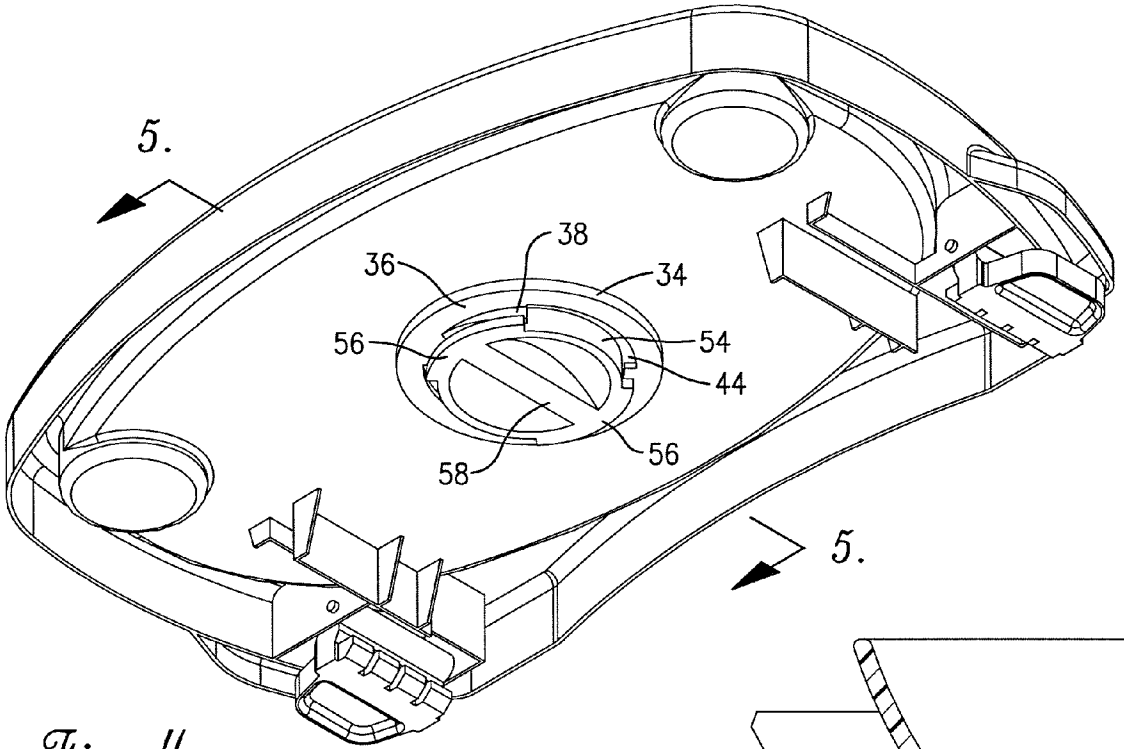
FIG. 4 is a bottom perspective view of the eating surface assembly illustrating the receptacle secured to the tray.

To attach the receptacle 22 to the tray 18, a user first aligns the plug 24 at the base of the receptacle with the socket 20 in the tray so that the locking tabs 56 on the plug are aligned with the keyway slots 44 in the socket. The user may then reach under the tray, grip the crossbar 58 or other gripping means, and rotate the receptacle and plug in a clockwise direction relative to the tray (from the perspective of the bottom of the tray as shown in FIG. 3) so that the locking tabs ride up the inclined surfaces 46 of the locking ramps 38 and onto the horizontal surfaces 48 of the ramps. The user continues to rotate the receptacle 22 relative to the tray 18 until the locking tabs 56 reach the stops 50 on the locking ramps 38 as best illustrated in FIG. 4.

As the locking tabs 56 ride up the locking ramps 58, the flange 52 on the receptacle is pulled down into the socket 20 until the upper surface of the flange is substantially level with the upper surface of the tray as shown in FIG. 1. This also compresses the gasket 60 slightly to better seal the plug 24 in the socket 20.

To remove the receptacle 22 from the tray 18, the user simply reverses the above process. Namely, the user grips the crossbar 58 or other gripping means, rotates the crossbar and attached receptacle relative to the tray until the locking tabs 56 are again aligned with the keyway slots 44, and then lifts the receptacle and its plug out of the socket.

Figure 6:
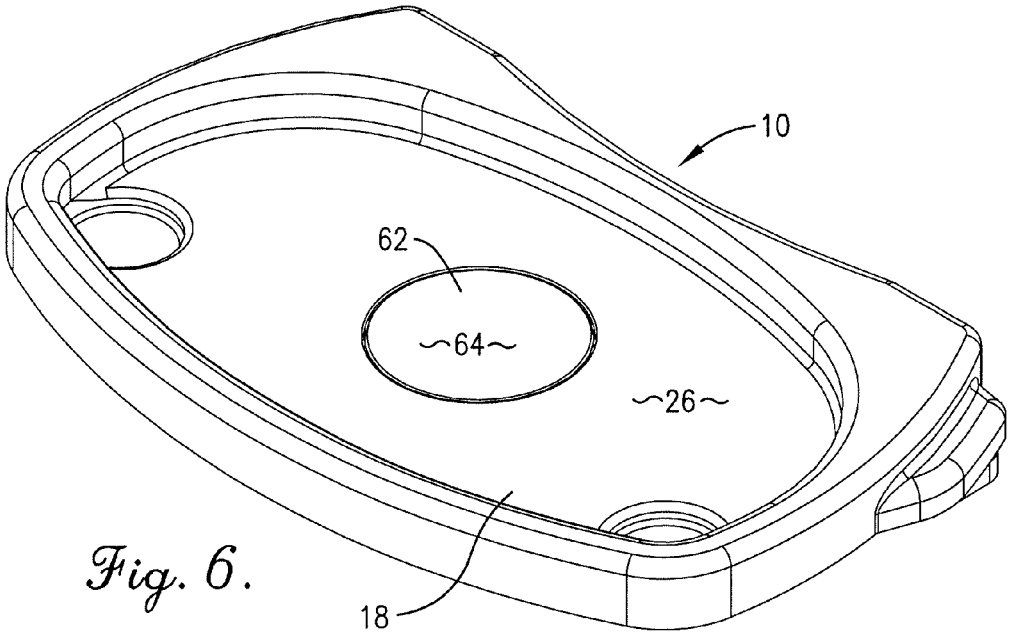
FIG. 6 is a perspective view of an eating surface assembly constructed in accordance with another preferred embodiment of the invention.

As illustrated in FIG. 6, the eating surface assembly 10 may also include a cover 62 for covering the socket in the tray when the receptacle is removed therefrom. The cover includes a generally planar plate 64 dimensioned to substantially close the socket 20 and a plug (not shown) depending from the plate for mating with the socket in the tray for releasably securing the cover to the tray. The plug of the cover is essentially identical to the plug on the receptacle and therefore need not be described in detail.

The eating surface assembly 10 may also include other accessories such as toys, book holders, make-up mirrors, and flower vases with integral plugs for mating with the socket on the tray. Moreover, although only one socket is shown in the drawing figures, the tray may include any number of sockets for releasably securing any number of receptacles and/or other accessories to the tray. The assembly 10 may also include attachments for a chain or rope and/or adapters to attach other proprietary devices such as Fisher-Price® toys.

Although the invention has been described with reference to the preferred embodiment illustrated in the attached drawing figures, it is noted that equivalents maybe employed and substitutions made herein without departing from the scope of the invention as recited in the claims. For example, the particular shapes, dimensions, and materials of the various components of the eating surface assembly may be altered without departing from the scope of the invention.

Having thus described the preferred embodiment of the invention, what is claimed as new and desired to be protected by Letters Patent includes the following:

1. An eating surface assembly comprising:

a tray for supporting food items thereon, the tray presenting an upper surface;

a socket integrally formed in the tray;

a receptacle; and a plug integrally formed on the receptacle and adapted for mating with the socket in the tray for releasably securing the receptacle on lop of the tray, the plug including a flange presenting an upper surface, the flange sized and configured so that its upper surface is substantially flush with the upper surface of the tray when the receptacle is secured to the tray, wherein the socket is a bayonet-type socket including a generally vertically-extending cylindrical sidewall depending from the top surface of the tray; a generally horizontally-extending shelf projecting inwardly from a lower edge of the cylindrical sidewall, the shelf defining an aperture extending through the tray; and a pair of spaced, inclined locking ramps depending from a lower face of the shelf.

2. The eating surface assembly as set forth in claim 1 wherein the tray is configured for removably attaching to a highchair.

3. The eating surface assembly as set forth in claim 1, wherein the horizontally-extending shelf includes two arcuate of increased width which define a pair of opposed keyway slots.

4. The eating surface assembly as set forth in claim 3, wherein the plug is a bayonet-type plug including a generally washer-shaped flange extending radially outward from a lower surface of the receptacle; a hollow, generally ring-shaped base depending from a lower surface of the flange; and a pair of locking tabs extending radially outward from a lower surface of the ring-shaped base and dimensioned to be received within the keyway slots of the socket.

5. The eating surface assembly as set forth in claim 4, the plug further including a handle bisecting the hollow ring-shaped base.

6. The eating surface assembly as set forth in claim 4, the flange presenting an outer margin and the locking tabs presenting an outer margin, wherein the outer margin of the locking tabs does not extend beyond the outer margin of the flange.

7. An eating surface assembly comprising:

a tray for supporting food items thereon, the tray presenting an upper surface;

a socket integrally formed in the tray;

a receptacle; and a plug integrally formed on the receptacle and adapted for mating with the socket in the tray for releasably securing the receptacle on top of the tray, the plug including a flange presenting an upper surface, the flange sized and configured so that its upper surface is substantially flush with the tipper surface of the tray when the receptacle is secured to the tray, further including a gasket for positioning between the plug and the socket for substantially sealing gaps between the plug and the socket for inhibiting migration of food or liquids into the socket when the receptacle is secured on top of the tray.

8. The eating surface assembly as set forth in claim 7, wherein the receptacle is selected from the group consisting of a bowl, a plate, a compartmentalized plate, a saucer, and a cup.

9. The eating surface assembly as set forth in claim 7, further including a cover for covering the socket in the tray when the receptacle is removed from the tray, the cover including a generally planar plate dimensioned to substantially close the socket and a plug depending from the plate for mating with the socket in the tray for releasably securing the cover to the tray.

10. The eating surface assembly as set forth in claim 7, wherein the flange includes a pair of depending, generally L-shaped ledges which define a T-shaped slot for receiving and retaining the gasket therein.

11. A high chair comprising:

a seat;

leg structure for supporting and elevating the seat above a floor; and a tray assembly that can be removably attached adjacent the seat for supporting food or liquid thereon, the tray assembly including a tray presenting an upper surface;

a socket integrally formed in the tray;

a receptacle; and a plug integrally formed on the receptacle and adapted for mating with the socket in the tray for releasably securing the receptacle on top of the tray, the plug including a flange presenting an upper surface, the flange sized and conligured so that its upper surface is substantially flush with the upper surface of the tray when the receptacle is secured to the tray, wherein the socket is a bayonet-type socket including a generally vertically-extending cylindrical sidewall depending from the top surface of the tray; a generally horizontallyextending shelf projecting inwardly from a lower edge of the cylindrical sidewall, the shelf defining a plug aperture extending through the tray; and a pair of spaced, inclined locking ramps depending from a lower face of the shelf.

12. The eating surface assembly as set forth in claim 11, wherein the tray is configured for removably attaching to a highchair.

13. The eating surface assembly as set forth in claim 11, wherein the horizontally-extending shelf includes two arcuate areas of increased width which define at least one opposed keyway slot.

14. The eating surfrce assembly as set forth in claim 13, wherein the plug is a bayonet-type plug including a generally washer-shaped flange extending radially outward from a lower surface of the receptacle; a hollow, generally ring-shaped base depending from a lower surface of the flange; and at least one locking tab extending radially outward from a lower surface of the ring-shaped base and dimension to be received within the keyway slot.

15. The eating surface assembly as set forth in claim 14, the plug further including a handle bisecting the interior of the hollow ring-shaped base.

16. A high chair comprising:

a seat;

leg structure for supporting and elevating the seat above a f1oor; and a tray assembly that can be removably attached adjacent the seat for supporting food or liquid thereon, the tray assembly including a tray presenting an upper surface;

a socket interally formed in the tray;

a receptacle; and a plug integrally formed on the receptacle and adapted for mating with the socket in the tray for releasably securing the receptacle on top of the tray, the plug including a flange presenting an upper surface, the flange sized and configured so that its upper surface is substantially flush with the upper surface of the tray when the receptacle is secured to the tray, further including a gasket for positioning between the socket and the plug for substantially sealing gaps between the plug and the socket for inhibiting the migration of food or liquids into the socket when the receptacle is secured on top of the tray.

17. The eating surface assembly as set forth in claim 16, wherein the receptacle is selected from the group consisting of a bowl, a plate, a compartmentalized plate, a saucer, and a cup.

18. The eating surface assembly as set forth in claim 16, further including a cover for covering the socket in the tray when the receptacle is removed from the tray, the cover including a generally planar plate sized and configured to substantially close the socket and a plug depending from the plate for mating with the socket for releasably securing the cover on top of the tray.

19. The eating surface assembly as set forth in claim 16, wherein the flange includes a pair of depending, generally L-shaped ledges which define a T-shaped slot for receiving the gasket therein.

* * * * *